US005348444A

United States Patent [19]

Metzinger et al.

[11] Patent Number: 5,348,444

[45] Date of Patent: Sep. 20, 1994

[54] SINGLE-BLADE IMPELLER FOR CENTRIFUGAL PUMPS

[75] Inventors: Wolfgang Metzinger, Pegnitz; Rolf Witzel, Lambsheim, both of Fed. Rep. of Germany

[73] Assignee: KSB Aktiengesellschaft, Frankenthal/Pfalz, Fed. Rep. of Germany

[21] Appl. No.: 945,966

[22] PCT Filed: May 2, 1991

[86] PCT No.: PCT/EP91/00833

§ 371 Date: Nov. 12, 1992

§ 102(e) Date: Nov. 12, 1992

[87] PCT Pub. No.: WO91/18210

PCT Pub. Date: Nov. 28, 1991

[30] Foreign Application Priority Data

May 12, 1990 [DE] Fed. Rep. of Germany ..... 4015331

[51] Int. Cl.[5] ..... F04D 29/38

[52] U.S. Cl. ..... 416/179; 416/223 B

[58] Field of Search ..... 416/179, 182, 185, 186 R, 416/223 B

[56] References Cited

U.S. PATENT DOCUMENTS

| | | | |
|---|---|---|---|
| 1,754,992 | 4/1930 | Fabrin . | |
| 2,272,469 | 2/1942 | Lannert | 416/186 R |
| 4,575,312 | 3/1986 | Erikson | 416/179 |
| 4,614,478 | 9/1986 | Sarvanne | 416/179 |
| 4,681,508 | 7/1987 | Kim | 416/185 |

FOREIGN PATENT DOCUMENTS

| | | | |
|---|---|---|---|
| 0506117 | 10/1951 | Belgium | 416/223 B |
| 0244844 | 11/1987 | European Pat. Off. . | |
| 1034031 | 7/1958 | Fed. Rep. of Germany | 416/223 B |
| 2732863 | 1/1979 | Fed. Rep. of Germany . | |
| 0042799 | 6/1970 | Finland | 416/179 |
| 1274289 | 9/1961 | France . | |
| 0094909 | 6/1922 | Switzerland | 416/223 B |
| 189936 | 3/1937 | Switzerland . | |

OTHER PUBLICATIONS

"Pumpen Regeln Wasserhaushalt", VDI-Nachrichten, No. 25/23, Jun. 1965.

*Primary Examiner*—Edward K. Look
*Assistant Examiner*—Mark Sgantzos
*Attorney, Agent, or Firm*—Darby & Darby

[57] ABSTRACT

A centrifugal pump for conveying fluids with suspended solids has a single-blade impeller. The blade angle, as measured at the meridian line of the blade, is positive at the rear end of the blade and less than 0 degrees along a portion of the blade which extends from the front end towards the rear end of the blade through an angle of at least 90 degrees. The inner side of the blade defines a segment of a circle which is coextensive with this portion of the blade. The front end of the blade has a surface which bridges the inner and outer sides of the blade, and such surface is either flat or forms an arc having a radius of curvature substantially greater than half the blade thickness.

10 Claims, 1 Drawing Sheet

SINGLE-BLADE IMPELLER FOR CENTRIFUGAL PUMPS

BACKGROUND OF THE INVENTION

1. Field of the Invention

The subject of the invention is a single-blade impeller for centrifugal pumps which convey liquids mixed with solid additions, particularly which convey dirty water with long fibrous components. A channel is formed between the blade, whose thickness varies along its length, and the front and rear cover plates of the single-blade impeller.

2. Description of the Related Art

The designer of a single-blade impeller to be used mainly for conveying waste water is faced with a complex problem. He must not only design the single-blade impeller such that an accumulation of solid components in the conveying path, and especially a blockage caused thereby, is reliably avoided. He must also think of satisfying the somewhat conflicting requirement for a most favorable mass distribution of the single-blade impeller which, of necessity, is constructed unsymmetrically. And not last, he must strive for a large energy conversion in the single-blade impeller developed by him.

The fulfillment of the named requirements is affected by various problems which result from the conveying conditions and the characteristics of the single-blade impeller and can mutually influence and interfere with one another in many unforeseeable ways.

In most applications, centrifugal pumps with single-blade impellers are operated at constant rpm. However, the conveying conditions of such a centrifugal pump normally undergo continuous change. Thus, the positive pressure head, for example, varies between a maximum and a minimum value. The working point of the centrifugal pump, that is, the intersection of the constant pump characteristic line and the variable system characteristic line, accordingly is likewise subjected to the change.

Now, a change in the relative blade inflow speed, as well as a change in the relative inflow direction, are associated with the shift in the working point. This causes a static pressure distribution, which is specific to the particular blade shape, along the blade contour. Integration of the pressure distribution from the blade inlet edge to the blade outlet edge yields a blade force which rotates as a transverse deflecting force relative to a fixed reference point. This transverse force, which is also referred to as hydrodynamic upthrust, constitutes an harmonically operating exciting force which, in a system susceptible to vibration, that is, e.g., an installation, can cause big problems. It should, therefore, be kept as small as possible.

Another problem with the single-blade or single-channel impellets is constituted by the mechanical imbalance resulting from the unequal mass distribution of the impeller. It was now obvious to use the mechanical imbalance in compensating for the hydrodynamic upthrust. The resultant force obtained by vector addition of the two forces was equalized by an added weight. Now, however, the mechanical imbalance and the centrifugal forces are load-independent forces while the hydrodynamic upthrust also changes the angle of attack relative to the blade with the quantity being conveyed. Consequently, compensation of the mechanical imbalance and the hydrodynamic force can be achieved for only one working point of the centrifugal pump.

Hence, there is the requirement to maintain the mechanical imbalance of the single-blade impeller, in addition to the hydrodynamic upthrust, as small as possible. A geometric shape, whose hydrodynamic upthrust does not experience a change in direction within the working range, is to be sought for the blade. For an airplane wing, one would here speak of a profile with a fixed pressure point.

Another important aspect of the blade design is the optimization of the cavitation behavior of the centrifugal pump. Due to the hydrodynamic asymmetry caused by the system, stationary and unstationary exciting forces, which occur in the form of vibrations and endanger the operation of the centrifugal pump, can be released by single-blade impellets which undergo premature cavitation.

Various contributions, which concern themselves in depth with mass equalization and the danger of blockages, are known from the literature. However, less attention has here been given to the mutual influence of the various forces acting on the impeller. The influence of cavitation, in particular, has not been assigned the significance which it deserves in reality.

Thus, the U.S. Pat. No. 1,754,992 concerns itself with the problem of equalizing the mass imbalance in a single-blade or single-channel impeller. The cited patent provides two measures for overcoming this problem: First, the blade forming the channel has a thickness which decreases steadily along its length so that, in spite of the asymmetrical mass distribution, a mass imbalance is produced which is relatively small overall. Second, a counterweight serving for mass equalization is arranged on the rear side of the impeller. In addition, the provision of recesses on the rear side of the single-blade impeller is set forth as a third possible measure. The location of application can be varied to optimize equalization of the imbalance.

Based on the determination that even the channel impellers particularly well-suited for the conveyance of solid additions further tend to be blocked under unfavorable circumstances, the art contemplated a solution to the problem. On the assumption that irregularities in the guide channel and non-uniform flow behavior caused thereby lead to accumulations and blockage, one attempted to achieve a most uniform guide channel.

The article "Pumpen regeln Wasserhaushalt" (VDI-Nachrichten, No. 25/23, June 1965) then proposed an impeller shape for waste water systems which, to avoid an acute danger of blockage, was provided with a smooth passage. It was further important for this impeller that the cross section of the intake be maintained over the entire length of the channel.

A similarly designed impeller, but in which the shape of the channel cross section changes along the path, has become known from the U.S. Pat. No. 4,575,312. The size of the cross section is, nevertheless, to remain the same or to increase slightly towards the outlet. Since the guide channel, whose cross section is similar to a pipe elbow, must be purchased with a very thick blade, the U.S. Pat. No. 4,575,312 foresaw the possibility of making the blade partly hollow. This, however, does not yet eliminate the problem of impeller imbalance which cannot be compensated for completely and over an entire range of rpm. In particular, the still relatively great mass of even a partially hollowed out blade plays a significant role here. Moreover, such an impeller requires an increased cost during manufacture.

SUMMARY OF THE INVENTION

It is the object of the invention to create a single-blade impeller of the type mentioned at the outset which, while fulfilling the basic prerequisite of freedom from blockages, has a calibrated design with respect to the mechanical imbalance and the hydrodynamic upthrust and reduces the cavitation present in the intake zone of the single-blade impeller to a minimum unharmful to troubleproof operation.

According to the invention, the object set forth is achieved in that the blade angle measured at the median line of the blade is 0 degrees or less from the inlet to at least 90 degrees of the angle of rotation whereas the blade angle is positive at the outlet.

This solution is based on the following consideration:

It practice, it is to be assumed that the first vapor bubbles at the blade occur when the static pressure of the flow decreases to the vapor pressure. The average pressure of the incoming flow is superimposed on the pressure difference generated by the blade. The minimum pressure established in the system which, of necessity, is in the region of the beginning of the blade, depends upon the average relative speed and especially upon the average vortex change. The average vortex change, in turn, is determined by the blade angle. A blade angle which remains the same or decreases along the flow path, as realized in the invention, results in a smaller average vortex change and thus a less reduced average pressure. Due to the shaping of the blade in accordance with the invention, premature, intensive bubble formation is accordingly prevented. Hence, the negatively influenced quietness of the centrifugal pump upon the floating off and imploding of the bubbles (cavitation) is avoided.

BRIEF DESCRIPTION OF THE DRAWINGS

The invention is described in greater detail with reference to an exemplary embodiment in which.

DESCRIPTION OF THE PRESENTLY PREFERRED EXEMPLARY EMBODIMENT

Figure 1:
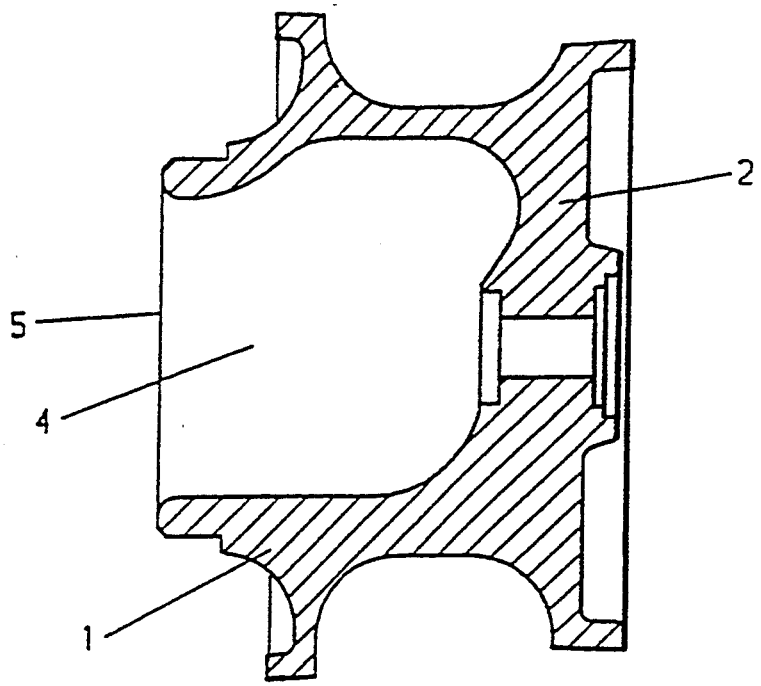
FIG. 1 is an axial section through an impeller designed in accordance with the invention.
Figure 2:
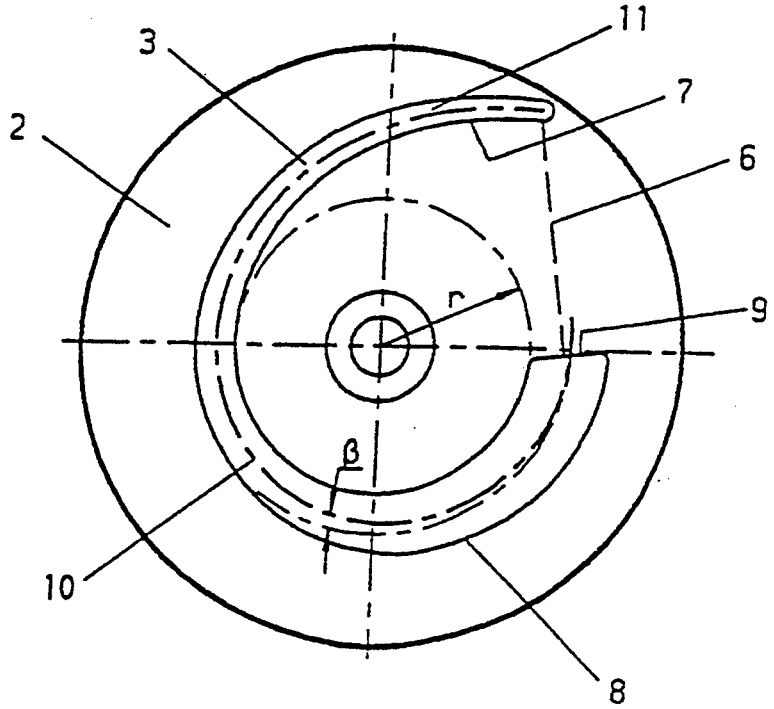
FIG. 2 is a radial section through the impeller of FIG. 1.

The single-blade impeller produced by means of a casting process defines a channel 4 between a front cover plate 1, a rear cover plate 2 and a blade 3. The cross section of the channel 4 decreases from the intake 5 of the single-blade impeller to the outlet 6.

The blade 3, which has a suction side 7 and a pressure side 8, is provided with a flattened blade head 9. In contrast to a conventional blade head having a contour radius of half the blade thickness, a stagnation point flow, which exerts a repulsive effect on solids contained in the flowing medium, is produced at a blade head with a very large contour radius. The flattening, which in the limit has an infinitely large contour radius, thus prevents the accumulation of long fibrous components.

The single-blade impeller is designed so that the suction side of the blade defines a semicircle, which is arranged concentrically with the rotational axis of the single-blade impeller, along the first 180 degrees of the angle of rotation. In accordance with the requirement of the invention, the blade angle beta measured at the median line 10 of the blade 3 is here, therefore, less than 0 degrees from the blade head 9, the inlet 5 into the impeller, to 180 degrees of the angle of rotation whereas it is positive at the outlet 6, that is, in the area of the blade end 11.

The suction side 7 of the blade 3 defines a semicircle of radius r, which is arranged concentrically with the rotational axis of the single-blade impeller, along the first 180 degrees of the angle of rotation.

The blade 3 has a thickness which decreases steadily towards the outlet. It thus has a mass distribution which is favorable for the imbalance behavior of the single-blade impeller. This advantage can be established for the entire single-blade impeller since it has no large material concentrations, particularly in the outer peripheral zone.

As seen in the meridian representation of FIG. 1, the suction side 7 and pressure side 8 of the blade 3 extend with their axes parallel along their entire lengths and merge into the cover plates 1 and 2 with a curve. The radius of such a curve here corresponds to approximately one-third of the width of the channel 4 at the outlet 6. It can be up to one-half of the channel width at the outlet 6.

The single-blade impeller of the invention has a relatively uncomplicated design. Accordingly, it is not only readily castable but also can be manufactured from sheet metal which, in particular, provides additional advantages with respect to the imbalance behavior.

What we claim is:

1. An impeller, particularly for use in a centrifugal pump designed to convey solids-containing fluids, comprising a rotational axis, an arcuate guiding blade for fluid which rotates about said rotational axis, said blade having a front cover plate, a rear cover plate, a suction side, and a pressure side which define a channel having an intake and an outlet, said channel having a cross-sectional area that decreases from said intake to said outlet, and said blade further having a median line, and a blade angle, as measured at said median line, which is positive adjacent to said outlet and is less than 0 degrees adjacent to said inlet.

2. The impeller of claim 1, wherein said blade angle is less than 0 degrees along a portion of said blade that extends along an arc of at least 90 degrees.

3. The impeller of claim 1, wherein said suction side defines a segment of a circle along said portion of said blade.

4. The impeller of claim 3, wherein said segment of said circle has an axis which is substantially coincident with said rotational axis.

5. The impeller of claim 1, wherein said blade has a substantially flattened head surface which extends between said suction side and said pressure side.

6. The impeller of claim 1, wherein said blade is a sole blade.

7. The impeller of claim 1, wherein said suction side and said pressure side each having a central portion of an axial section such that said central portions are substantially parallel to one another in the direction of said axis.

8. The impeller of claim 7, wherein said outlet of said channel having a predetermined width, and said suction and pressure sides central portions each merging into said front cover plate and said rear cover plate with a curve having a radius which is approximately equal to one-third of said predetermined width.

9. The impeller of claim 1, wherein said blade is made of a plurality of sheet metal members.

10. The impeller of claim 9, wherein said members are welded to one another.

* * * * *